United States Patent [19]

Kay, Jr.

[11] 4,019,942

[45] Apr. 26, 1977

[54] MAINTAINING PLASTICIZER TEMPERATURE IN TOBACCO FILTER ROD FORMATION, AND APPARATUS THEREFOR

[75] Inventor: James A. Kay, Jr., Richmond, Va.

[73] Assignee: Philip Morris Incorporated, New York, N.Y.

[22] Filed: Mar. 12, 1975

[21] Appl. No.: 557,514

[52] U.S. Cl. ..... 156/180; 93/1 C; 93/77 FT; 118/5; 156/441; 156/578; 236/34.5;93

[51] Int. Cl.[2] ..... G05G 15/00

[58] Field of Search ..... 131/267; 93/1 C, 77 FF; 156/180, 441, 578; 118/5; 165/35

[56] References Cited

UNITED STATES PATENTS

| | | | |
|---|---|---|---|
| 3,029,612 | 4/1962 | Victor | 236/93 A |
| 3,043,736 | 7/1962 | Touey | 156/180 |
| 3,186,688 | 6/1965 | Michael | 222/145 |
| 3,365,346 | 1/1968 | Fritz et al. | 156/180 |
| 3,741,846 | 6/1973 | Greve | 156/441 |
| 3,759,217 | 9/1973 | Wiegmann | 118/5 |
| 3,902,406 | 9/1975 | Reichert | 156/578 |

*Primary Examiner*—William A. Powell
*Assistant Examiner*—Michael W. Ball
*Attorney, Agent, or Firm*—Watson Leavenworth Kelton & Taggart

[57] ABSTRACT

The temperature of the plasticizer material which is applied to a tow band of filter material in a cigarette rod forming operation is maintained at substantially the ambient temperature of the environment in which the forming operation is being carried out thereby to provide substantially constant viscosity of the plasticizer, the temperature being maintained by circulating a cooling fluid through the plasticizer source to maintain it at a temperature of about 70° F. to about 80° F. Apparatus for maintaining the source temperature in the prescribed range also is disclosed.

4 Claims, 3 Drawing Figures

MAINTAINING PLASTICIZER TEMPERATURE IN TOBACCO FILTER ROD FORMATION, AND APPARATUS THEREFOR

BACKGROUND OF THE INVENTION

In the manufacture of cigarette filter rod, it is common practice to apply a plasticizer, e.g., triacetin to a tow band of filter material such as cellulose acetate preliminary to actually enclosing the filter material in a wrapper thus to form a filter plug structure, such plug structure being formed in a continuous stock thereof in known manner with known plug forming apparatus. The plasticizer is applied to promote selective adhesion of the fibers of the cellulose acetate at points of crossing to give a cohesive structural character to the fiber mass. The plasticizers used in such operation generally can be classed as relatively low flash point liquids so that it is desirable that they not be stored and supplied and used in the rod making operation at relatively high temperature. For example, in the case of triacetin, it has a flash point of about 280° F., and it is recommended that it not be subjected to storage temperatures over 100° F. Moreover, a proper supplying of the triacetin to the application operation requires that the plasticizer have a relatively constant viscosity for uniform pumping from a source to the application operation and that the viscosity be such at the transfer device, e.g., dip and transfer rolls, which actually apply the plasticizer to the tow band. To maintain viscosity relatively constant at the plasticizer source it is required that the temperature at such source be maintained relatively constant. In practice this is difficult to achieve because the pump for conveying plasticizer to the application device as well as external heat souce devices used in the overall rod forming operation transfer heat to the plasticizer, the last-mentioned including, e.g, the high velocity blower supplying air to the banding jets. Furthermore, it is common to return unused plasticizer from the application operation to the source thereof, which return plasticizer flow tends to increase the temperature of the plasticizer at the source. If the plasticizer heats up unduly, it will become less viscous and possibly require adjustment to the applicator device to insure proper quantities thereof are transferred to the tow band — an undesirable condition as it impedes manufacturing efficiency. Similarly, too high a temperature will not permit enough plasticizer to adhere to a transfer roll because of very low viscosity unless the roll speed is substantially increased. This again is undesirable. Accordingly, it is desirable that the temperature and hence viscosity of the plasticizer used in a cigarette filter rod forming operation be controlled relatively precisely to insure optimized operation of the filter rod forming apparatus, other than by heating excessively as in past practice.

SUMMARY OF THE INVENTION

The present invention is concerned generally with improvement in a method and the apparatus with which cigarette filter rod is formed. More specifically the invention is concerned with establishing and maintaining the temperature of the source of plasticizer material which is applied to the tow band of filter material as a preliminary to rod formation at substantially the temperature of the environment in which the said forming operation is being carried out. This temperature is most generally in the range of about 70° F. to about 80° F.

In accordance with the invention, there is circulated through the confined pond of plasticizer, chilled water, the circulation being in a closed circuit flow and advantageously in the pond adjacent the bottom thereof. The chilled water advantageously may be provided from a source thereof as is conventionally employed in known forms of cigarette filter rod forming apparatus, the flow thereof through the pond being effected as required under thermostatic control responsive to variation in the plasticizer temperature, i.e., where the plasticizer is triacetin and the pond temperature exceeds 80° F., chilled water is permitted to circulate therethrough until the temperature is reduced to 70° F. at which point the chilled water circulation is diverted from the pond. Conveniently, the closed circuit for chilled water flow in the pond is provided by a coil disposed within the pond adjacent the bottom thereof, said coil comprising a plurality of sinuous conduit windings disposed in substantially planar alignment across substantially the full expanse of the tank defining the pond enclosure. A three-way valve connected respectively with the chilled water supply, coil and a by-pass conduit is controlled by a thermostatic device to orient said valve to pass chilled water to and through the coil as when cooling of the pond is required, or to the by-pass conduit through which the chilled water is returned to the source thereof without passage through the pond as when the pond temperature is within the requisite range.

The invention accordingly comprises the several steps and the relation of one or more of such steps with respect to each of the others, and the device embodying features of construction, combination of elements, and arrangements of parts which will adapt to effect such steps, all as exemplified in the following detailed disclosure and the scope of the invention will be indicated in the claims.

BRIEF DESCRIPTON OF THE DRAWINGS

Other objects of the invention will be in part obvious and will in part appear from the detailed description taken in conjunction with the accompanying drawings wherein like reference numerals identify like parts throughout and in which:

FIG. 1 is a side elevational view of a cigarette filter rod forming apparatus, the temperature of the confined pond of plasticizer therein being maintained at substantially the ambient temperature of the environment in which the apparatus is operating, portions of the apparatus being broken away for depiction of the reservoir in which the plasticizer is confined, other parts of the apparatus not being shown.

DESCRIPTION OF THE PREFERRED EMBODIMENT

Figure 1:
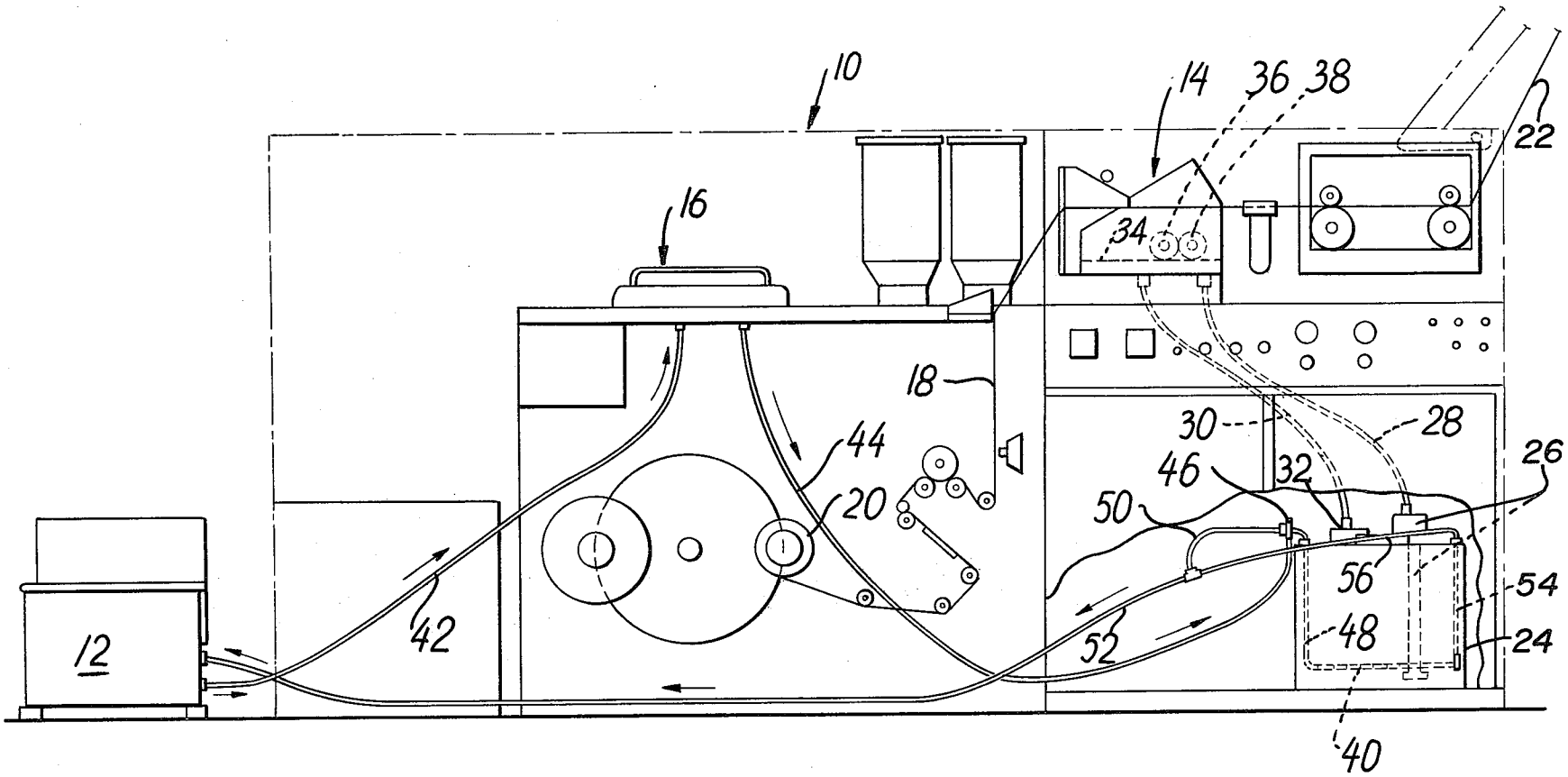
Figure 2:
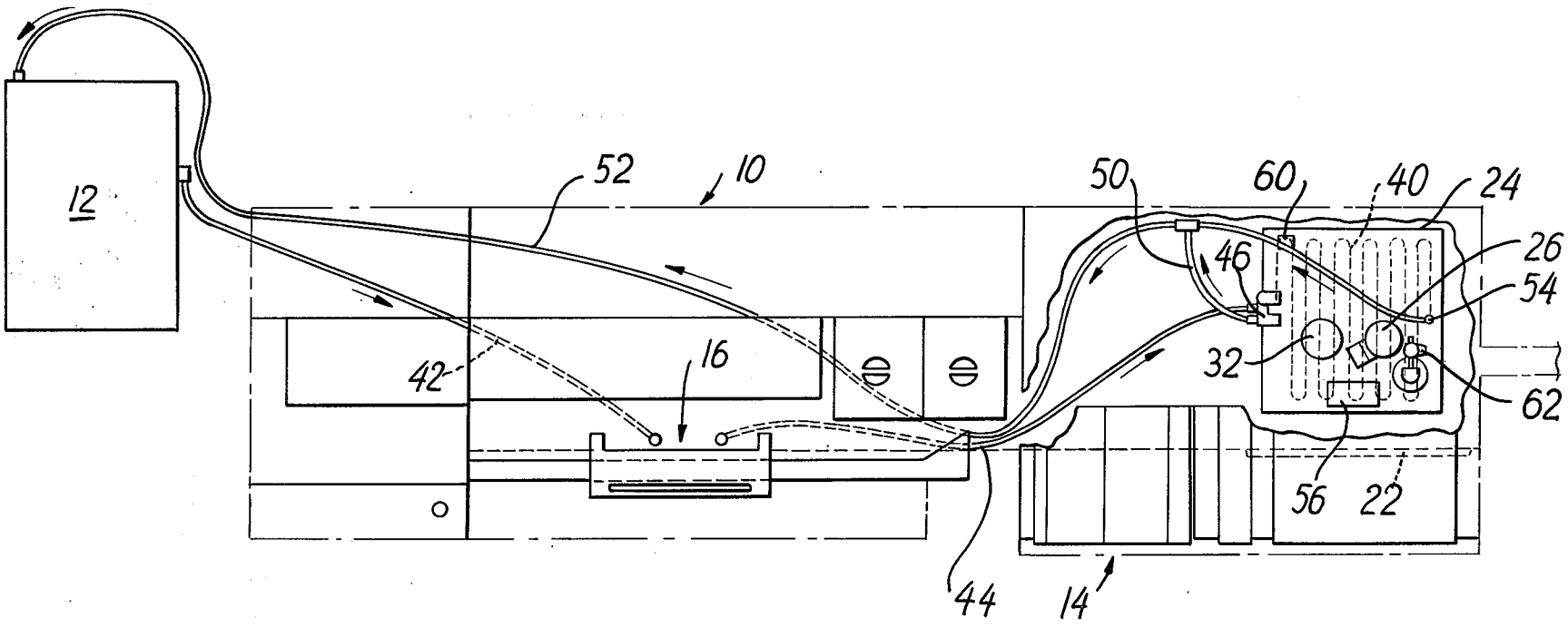
FIG. 2 is a top plan view of the apparatus depicted in FIG. 1.

Referring now to FIGS. 1 and 2 there is depicted cigarette filter plug forming apparatus 10, e.g., a Hauni-Werke KDF-2 plug maker. Such apparatus 10 includes a source of cooling water 12, a plasticizer application device shown generally at 14, a cooling bar unit shown generally at 16 at which the seam on the wrapped cigarette filter rod is formed, the wrapper material 18 being supplied from a stock 20 thereof, and the filter material such as cellulose acetate being supplied in a tow band 22 thereof from a tow banding operation (not shown), all such devices being embodied in known manner and for known purposes in the plug maker identified above. There is also included a reservoir or tank 24 in which is confined a pond of plasticizer, e.g., triacetin, the plasticizer being conveyed by pump unit 26 through supply line 28 to the application device 14, the said application operation being such that unused plasticizer is returned to the tank 24 through return line 30, the said line 30 being connected with tank 24 by means of a strainer unit 32. In operation, an advancing tow band of filter material 22 which has been subjected to an air banding operation in devices (not shown) enters apparatus 10 and passes through the applicator device 14 in which plasticizer picked up from a stock thereof as at 34 by pick-up and transfer roll 36, is applied to the tow band by brush 38 or like device. The tow band 22 then passes on to the wrapping operation in which it is wrapped in wrapper 20 to form a continuous filter rod stock.

The plasticizer conveyance operation and return of unused plasticizer to tank 24 results in transfer of heat to the plasticizer as well as there being heat transferred thereto by other operating devices associated with the rod forming operation with consequence that the plasticizer in tank 24 tends to heat up. As indicated earlier where the plasticizer is triacetin, a relatively low flash point material, it is desirable that the temperature thereof be maintained at a relatively constant value for among other reasons to maintain a relatively constant viscosity of plasticizer. Thus if the temperature of triacetin were too high the viscosity thereof, e.g., 5–7 centistokes would be such that not enough of the plasticizer would adhere to the transfer roll to be commensurate with the quantity requirement for normal operational speed of the rod maker apparatus. It has been found that satisfactory viscosity in the range of 13–17 centistokes can be achieved in the plasticizer in tank 24 if the temperature thereof is maintaned at the ambient temperature of the environment in which the forming operation is being carried out. More particularly the temperature should be maintained in the range of 70° F. –80° F.

Figure 3:
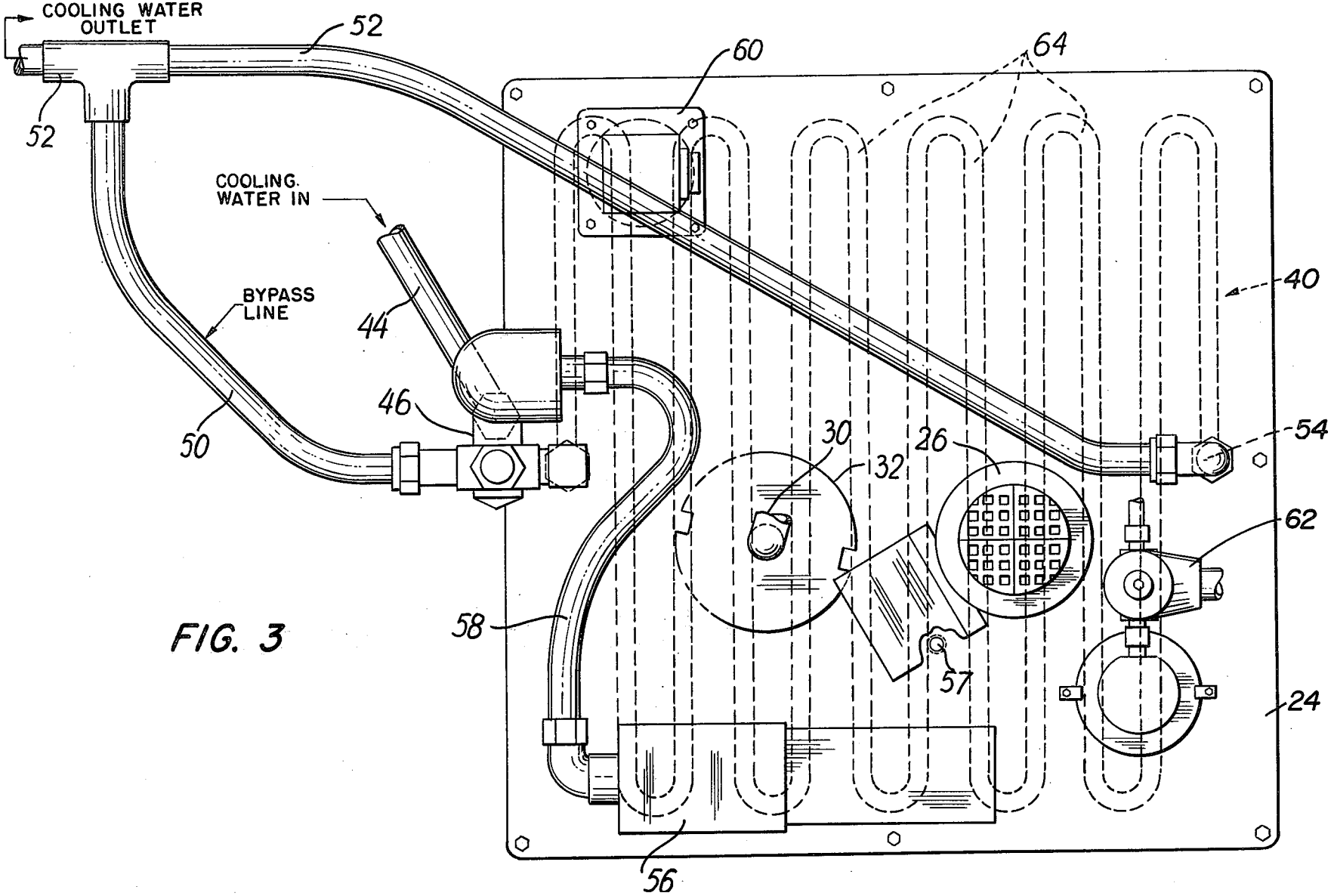
FIG. 3 is an enlarged fragmentary plan view of the reservoir in which the plasticizer is confined, depicting in greater detail the cooling coil disposed therein as well as the manner of controlling circulation of chilled or cooling water through the coil or through the by-pass conduit.

With continuing reference to FIGS. 1 and 2 and further with reference to FIG. 3, the present invention provides that the tendency of the plasticizer to heat up can be controlled and substantially uniform viscosity maintained by circulating a cooling fluid, e.g., chilled water through a cooling coil 40 disposed in tank 24. For this purpose, condits 42, 44 supply chilled water from source 12 by way of cooling bar unit 16 to a three-way valve 46 mounted on top of tank 24, such valve additionally having connection to an upstanding supply leg 48 of the coil. Valve 46 also is connected to a by-pass conduit 50 the last-mentioned conduit in turn being connected to chilled water return conduit 52 which is connected to an upstanding return leg 54 of the coil 40. A thermostat 56 having a bulb 57 is mounted on top of tank 24 and is electrically connected as by means of cable 58 to the electrically operated three-way valve 46 to selectively orient the same responsive to the temperature of the plasticizer in tank 24. Thus if the plasticizer temperature goes above 80° F., thermostat 56 will operate valve 46 to orient it such that chilled water from line 44 flows into and through coil 40. When the plasticizer has been cooled down to a desired level, e.g., 70° F., thermostat 56 will operate valve 46 to cut off chilled water supply to the coil and will orient the valve to by-pass the supply through conduit 50. Other predetermined temperature range settings could be provided to have the thermostat control plasticizer temperature over a narrower range, e.g., 75°–80° F., etc.

Coil 40 can be provided in various configurations, that depicted being particularly advantageous in that it offers no obstruction to the various other components received in the tank, e.g., pump 26, float valve 60, plasticizer make-up line 62, and strainer 32. The depicted coil form comprises a plurality of continuous relatively sinuous conduit windings 64 which are suspended or disposed in substantially planar alignment across substantially the full expanse of tank 24 adjacent to but spaced above the tank bottom. Other configurations such as a four-sided ascending helix-like form conforming closely to the tank walls so as to leave space for the pump etc. also could be employed for coil 40.

It will be apparent from the foregoing that the present invention provides a novel method and apparatus for controlling the viscosity of the plasticizer used in a cigarette filter rod forming apparatus. It will be appreciated by those skilled in the art that certain modifications can be made in both the method and apparatus, if for example, the particular type of plasticizer requires a somewhat different controlled temperature range. However, such modifications are considered to be within the scope of the present invention as defined in the claims.

What is claimed is:

1. In a cigarette filter rod forming operation in which a plasticizer material is conveyed from a pond thereof and applied to a tow band of filter material in an application operation preliminary to enclosing said tow band in a wrapper, the conveyance and application of said plasticizer being made under such conditions that heat is transferred to said plasticizer with a portion of the said plasticizer conveyed to the application operation being returned to said pond whereby the temperature of said pond tends to increase, the improvement of establishing and maintaining the temperature of said pond of plasticizer material at substantially the ambient temperature of the environment in which said forming operation is carried out by circulating a flow of cooling water through said pond in a closed circuit flow course extending substantially across the full expanse of said pond adjacent the bottom thereof.

2. The forming operation of claim 1 in which the plasticizer material is triacetin, and said pond is maintained at a temperature of about 70° F. to about 80° F.

3. In apparatus for forming cigarette filter rod which includes means for advancing a tow band of filter material in a predetermined direction, an upright tank, a source of plasticizer material received in said tank as a pond thereof, application means for applying said plasticizer material to said advancing tow band, and means for conveying plasticizer from said pond to said application means, there further being means for collecting and returning unused plasticizer from said application means to said pond, the improvement comprising means for maintaining the temperature of said pond at a value in a predetermined range, said means comprising a source of circulating cooling fluid, a coil disposed in said tank, said coil having at least a portion thereof disposed in said pond closely adjacent to but spaced from the bottom of said tank, said portion comprising a plurality of relatively sinuous windings disposed in substantialy planar alignment across substantially the full expanse of said tank, and means operative for establishing flow communication between said coil and said cooling fluid source whenever the temperature of the plasticizer in said pond exceeds the maximum value in said predetermined range, said means being inoperative whenever the temperature of the plasticizer in said pond is at a value within or below said predetermined range, said means for establishing flow communication between said coil and said cooling fluid source including a three-way valve having connection respectively with said cooling fluid source, said coil, and a by-pass conduit, and a thermostat control sensing the temperature of said plasticizer and operative to orient said three-way valve to pass cooling fluid from said source to said coil, or from said source to the by-pass conduit.

4. The apparatus of claim 3 in which said cooling fluid is chilled water, the plasticizer material being triacetin, and the means for establishing flow communication between said coil and said pond of cooling fluid being operative whenever the temperature of the plasticizer exceeds 80° F.

* * * * *